US008976068B2

(12) United States Patent
Hamabe

(10) Patent No.: US 8,976,068 B2
(45) Date of Patent: Mar. 10, 2015

(54) ANTENNA APPARATUS HAVING FIRST AND SECOND ANTENNA ELEMENTS FED BY FIRST AND SECOND FEEDER CIRCUITS CONNECTED TO SEPARATE GROUND CONDUCTORS

(71) Applicant: Panasonic Intellectual Property Management Co., Ltd., Osaka (JP)

(72) Inventor: Taichi Hamabe, Hyogo (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 224 days.

(21) Appl. No.: 13/654,738

(22) Filed: Oct. 18, 2012

(65) Prior Publication Data

US 2013/0038507 A1 Feb. 14, 2013

Related U.S. Application Data

(63) Continuation of application No. PCT/JP2011/006864, filed on Dec. 8, 2011.

(30) Foreign Application Priority Data

Mar. 16, 2011 (JP) ..... 2011-057496

(51) Int. Cl.
*H01Q 1/38* (2006.01)
*H01Q 1/48* (2006.01)
(Continued)

(52) U.S. Cl.
CPC . *H01Q 1/38* (2013.01); *H01Q 1/48* (2013.01); *H01Q 21/30* (2013.01); *H01Q 9/30* (2013.01)
USPC ..... 343/700 MS; 343/702

(58) Field of Classification Search
CPC ..... H01Q 1/38; H01Q 1/24; H01Q 1/48; H01Q 9/30; H01Q 21/30
USPC ..... 343/700 MS, 702, 893, 848
See application file for complete search history.

(56) References Cited

U.S. PATENT DOCUMENTS 6,320,547 B1 * 11/2001 Fathy et al. ..... 343/700 MS
7,369,098 B2 5/2008 Chen
(Continued)

FOREIGN PATENT DOCUMENTS

CN 1588698 3/2005
CN 1954461 4/2007
(Continued)

OTHER PUBLICATIONS

International Search Report issued Mar. 13, 2012 in corresponding International (PCT) Application No. PCT/JP2011/006864.
(Continued)

*Primary Examiner* — Hoang V Nguyen
(74) *Attorney, Agent, or Firm* — Wenderoth, Lind & Ponack, L.L.P.

(57) ABSTRACT

An antenna element is connected to a feeder circuit, and an antenna element is connected to a feeder circuit. The grounding terminal of the feeder circuit is grounded by being connected to a grounding conductor. The grounding terminal of the feeder circuit is grounded by being connected to a grounding conductor. Grounding conductors interpose therebetween the first portion of the antenna element, and grounding conductors interpose therebetween the third portion of the antenna element. The grounding conductors are mutually electrically connected by jumper conductors.

13 Claims, 6 Drawing Sheets

(51) Int. Cl.
*H01Q 21/30* (2006.01)
*H01Q 9/30* (2006.01)

(56) References Cited

U.S. PATENT DOCUMENTS

| | | | |
|---|---|---|---|
| 8,237,614 | B2 | 8/2012 | Kuramoto et al. |
| 2004/0227669 | A1 | 11/2004 | Okado |
| 2007/0273607 | A1 | 11/2007 | Chen |
| 2010/0026586 | A1 | 2/2010 | Kuramoto et al. |

FOREIGN PATENT DOCUMENTS

| | | |
|---|---|---|
| CN | 101622755 | 2/2013 |
| EP | 1 089 448 | 4/2001 |
| JP | 2001-102954 | 4/2001 |
| JP | 2004-328717 | 11/2004 |
| JP | 2006-165933 | 6/2006 |
| JP | 2007-281906 | 10/2007 |
| JP | 2011-015329 | 1/2011 |

OTHER PUBLICATIONS

International Preliminary Report on Patentability and Written Opinion of the International Searching Authority issued Oct. 10, 2013 in International (PCT) Application No. PCT/JP2011/006864.

Office Action and Search Report issued Mar. 14, 2014 in corresponding Chinese Application No. 201180017120.7, with English translation.

* cited by examiner

ANTENNA APPARATUS HAVING FIRST AND SECOND ANTENNA ELEMENTS FED BY FIRST AND SECOND FEEDER CIRCUITS CONNECTED TO SEPARATE GROUND CONDUCTORS

This is a continuation application of International application No. PCT/JP2011/006864 as filed on Dec. 8, 2011, which claims priority to Japanese patent application No. JP 2011-057496 as filed on Mar. 16, 2011, the contents of which are incorporated herein by reference.

BACKGROUND

1. Technical Field

The present disclosure relates to an antenna apparatus including a plurality of antenna elements, a wireless communication apparatus including the antenna apparatus, and an electronic apparatus having the wireless communication apparatus.

2. Description of the Related Art

BACKGROUND

Portable electronic apparatus including a wireless communication apparatus and a display has been popularized. In this case, the wireless communication apparatus receives broadcasting signals such as broadcasting signals of digital terrestrial television broadcasting, and the display apparatus displays a received broadcasting signal. As a method for achieving reception with high sensitivity, such electronic apparatus uses adaptive control such as a combined diversity method to combine received signals received in in-phase by a plurality of antenna elements. In addition, it is necessary to provide a plurality of antenna elements inside or outside a casing of an electronic apparatus in order to perform adaptive control, and various methods have been proposed about the configuration and arrangement methods of the plurality of antenna elements (See Japanese Patent Laid-open Publication No. JP 2007-281906A, for example.).

In the electronic apparatus as described above, it is desirable that the electronic apparatus has high receiver sensitivity in various directions. However, if a plurality of antenna elements, that use radio waves within the same frequency band, are used to increase gain of an antenna apparatus of the electronic apparatus in various directions, then signal mixing from the other antenna elements will be caused due to electromagnetic coupling among the antenna elements. This sometimes led to decreased signal-to-noise ratio during reception with the antenna elements, and substantially decreased gain.

SUMMARY

In one general aspect, the instant application describes an antenna apparatus including a plurality of antenna elements, a wireless communication apparatus including the antenna apparatus, and an electronic apparatus including the wireless communication apparatus, each capable of solving the above-described problems and capable of substantially preventing the decrease in the gain as compared with the prior art.

An antenna apparatus according to the first disclosure is an antenna apparatus including a first antenna element, a second antenna element, and a feeder circuit board including a first feeder circuit that feeds to the first antenna element, and a second feeder circuit that feeds to the second antenna element. The feeder circuit board is a multi-layer board including first and second grounding conductors. A grounding terminal of the first feeder circuit is connected to the first grounding conductor to be grounded, so that a ground current flows through the first grounding conductor when a radio wave is transmitted and received with the first antenna element. A grounding terminal of the second feeder circuit is connected to the second grounding conductor to be grounded, so that a ground current flows through the second grounding conductor when a radio wave is transmitted and received with the second antenna element.

The above-described antenna apparatus preferably further includes an insulating substrate on which each of the first and second antenna elements is formed in a form of a conductor pattern. The first antenna element includes a first portion that extends in a predetermined first direction and has one end connected to the first feeder circuit, and a second portion that extends in a predetermined second direction and has one end connected to another end of the first portion. The second antenna element includes a third portion that extends in the first direction and has one end connected to the second feeder circuit, and a fourth portion that extends in a predetermined third direction and has one end connected to another end of the third portion. The antenna apparatus further includes a third grounding conductor formed between the first and third portions on the insulating substrate.

In addition, the above-described antenna apparatus preferably further includes fourth and fifth grounding conductors, each formed on the insulating substrate. The third and fourth grounding conductors are formed so as to interpose the first portion therebetween, and the third and fifth grounding conductors are formed so as to interpose the third portion therebetween.

Further, the above-described antenna apparatus preferably further includes connecting element that electrically connects the third, fourth and fifth grounding conductors with each other.

Still further, in the above-described antenna apparatus the first and second antenna elements preferably have substantially same resonance frequencies as each other.

A wireless communication apparatus according to the second disclosure is a wireless communication apparatus including the above-described antenna apparatus, and a wireless communication circuit that transmits and receives a wireless signal by using the antenna apparatus.

An electronic apparatus according to the third disclosure is an electronic apparatus including the above-described wireless communication apparatus including an antenna apparatus and a wireless communication circuit that transmits and receives a wireless signal by using the antenna apparatus, and a display apparatus that displays a video signal included in the wireless signal.

According to the antenna apparatus, the wireless communication apparatus and the electronic apparatus of the present disclosure, the grounding terminal of the first feeder circuit is connected to the first grounding conductor to be grounded, so that a ground current flows through the first grounding conductor when a radio wave is received with the first antenna element. The grounding terminal of the second feeder circuit is connected to the second grounding conductor to be grounded, so that a ground current flows through the second grounding conductor when a radio wave is received with the second antenna element. Therefore, the first antenna element and the second antenna element can be sparsely coupled with each other. Therefore, it is possible to prevent signal mixing from another antenna element in the first and second antenna elements, and it is possible to substantially prevent the decrease in the gain during the reception of the respective signals.

BRIEF DESCRIPTION OF THE DRAWINGS

These and other aspects and features of the present disclosure will become clear from the following description taken in conjunction with the preferred embodiments thereof with reference to the accompanying drawings throughout which like parts are designated by like reference numerals, and in which.

DETAILED DESCRIPTION

Figure 1:
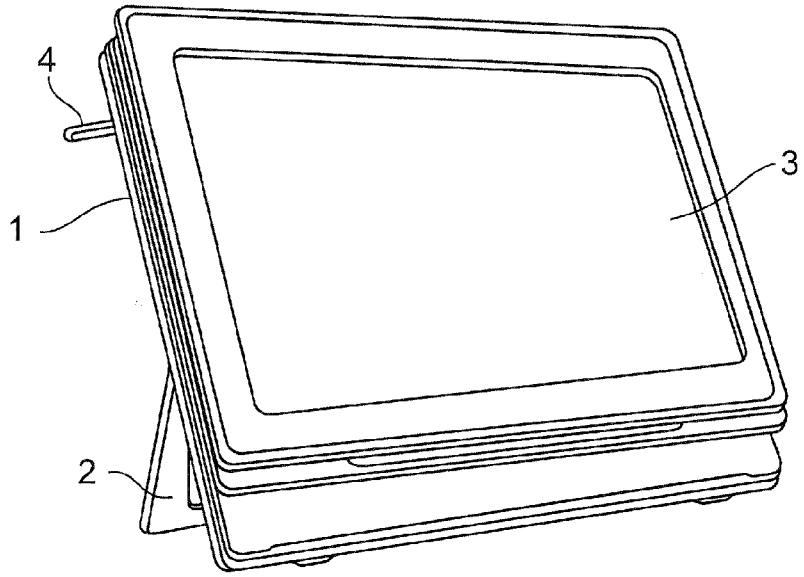
FIG. 1 illustrates a perspective view showing an appearance of an electronic apparatus according to the preferred embodiment of the present disclosure, seen from the front the electronic apparatus.

Preferred embodiments of the present disclosure will be described hereinafter with reference to the drawings. In the preferred embodiments, components similar to each other are denoted by the same reference numerals.

Figure 2:
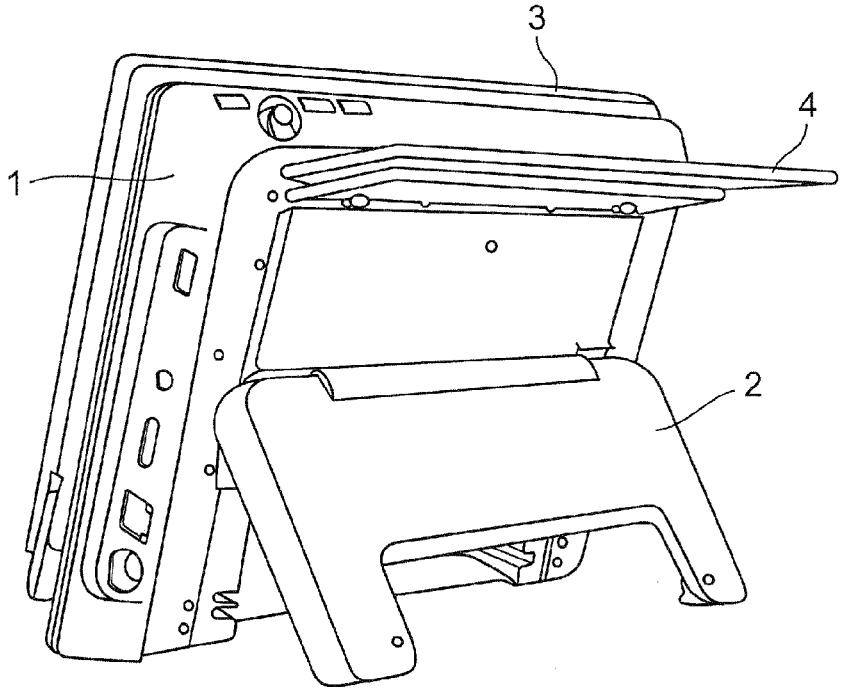
FIG. 2 illustrates a perspective view showing the appearance of the electronic apparatus shown in FIG. 1 seen from the back of the electronic apparatus.

FIG. 1 illustrates a perspective view showing an appearance of an electronic apparatus according to the preferred embodiment of the present disclosure, seen from the front the electronic apparatus, and FIG. 2 illustrates a perspective view showing the appearance of the electronic apparatus of FIG. 1 seen from the back of the electronic apparatus. The electronic apparatus of the present preferred embodiment is a portable type television broadcasting receiver apparatus for receiving radio waves within a frequency band (473 MHz to 767 MHz) of digital terrestrial television broadcasting. Referring to FIGS. 1 and 2, the electronic apparatus of the present preferred embodiment is configured to include a main unit casing 1, a stand 2, a display apparatus 3, and an antenna apparatus 4.

Referring to FIGS. 1 and 2, the stand 2 is formed of resin, and retains the main unit casing 1 in an upright state. In addition, the display apparatus 3 is, for example, a liquid crystal display apparatus or an organic EL (Electronic-Luminescence) display apparatus, which has a thin flat shape, and is provided on the front surface of the main unit casing 1. Further, the antenna apparatus 4 is pivotably supported to the back surface of the main unit casing 1. The antenna apparatus 4 is an antenna apparatus using diversity reception system. The antenna apparatus 4 receives the broadcasting signal of the digital terrestrial television broadcasting by using a plurality of antenna elements 7 and 8 (See FIG. 3) described later in detail, amplifies respective received signals, and outputs amplified received signals.

In addition, referring to FIGS. 1 and 2, a main board for controlling the entire electronic apparatus is built in the main unit casing 1. Concretely speaking, the main board is configured to include a power supply circuit to supply power voltages to respective circuits on the main board, a drive circuit, and a tuner. In this case, the tuner is a wireless communication circuit to combine two received signals from the antenna apparatus 4 into one received signal by executing diversity processing on the two received signals, and output a video signal and an audio signal included in a combined received signal. The drive circuit displays an image on the display apparatus 3 by executing predetermined image processing on the video signal from the tuner by driving the display apparatus 3. In addition, the main unit casing 1 has a sound processing circuit which executes predetermined processing on the audio signal from the tuner and outputs a resultant signal to a loudspeaker, a recording apparatus and a reproducing apparatus for the video signal and the audio signal, and a metal member for heat radiation to reduce heat generated from parts such as the main board and so on. It is noted that the antenna apparatus 4 and the above-described tuner constitute a wireless communication apparatus to receive wireless signals.

Figure 3:
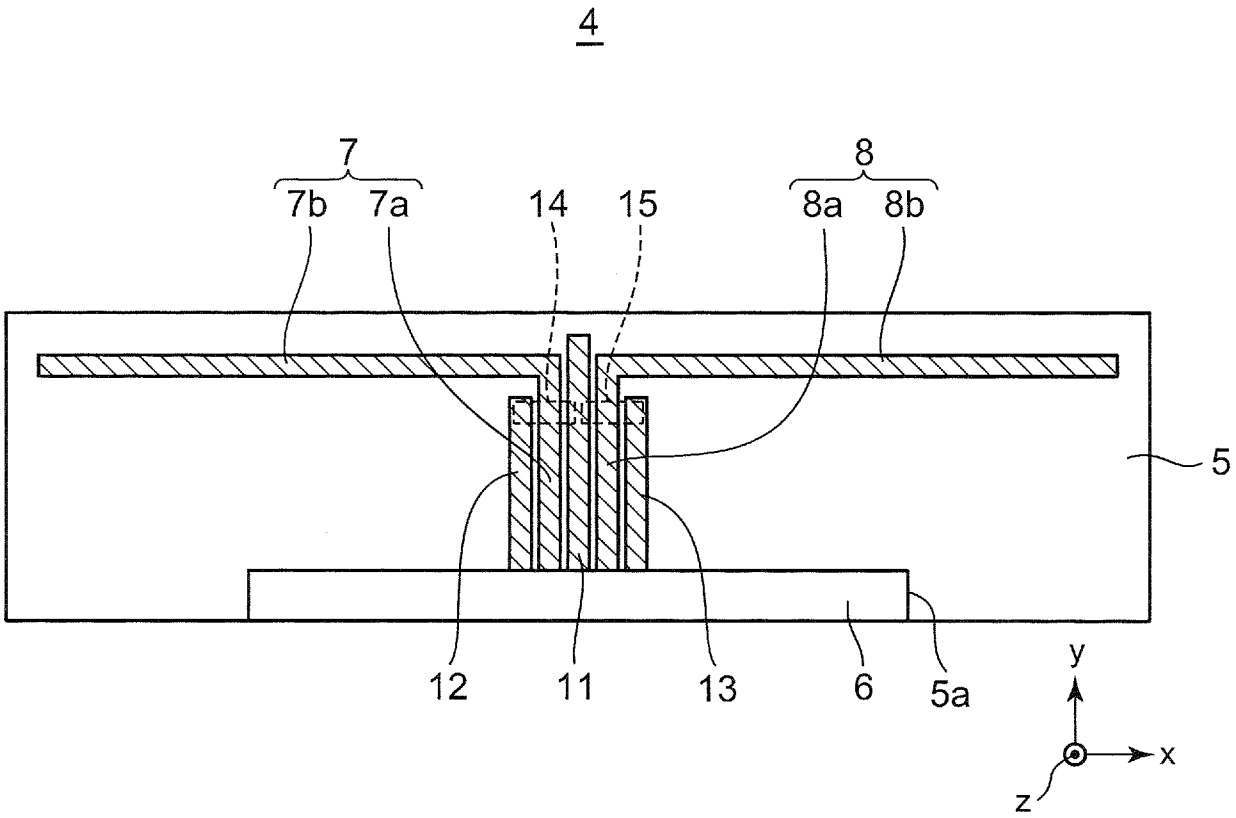
FIG. 3 illustrates a top view showing an insulating substrate 5 and a feeder circuit board 6, which are provided in an antenna apparatus casing of an antenna apparatus 4 shown in FIG. 1.

FIG. 3 illustrates a top view showing an insulating substrate 5 and a feeder circuit board 6 (matching board), which are provided in an antenna apparatus casing (antenna cover) of the antenna apparatus 4 of FIG. 1. Referring to FIG. 3, the antenna apparatus 4 is configured to include the insulating substrate 5 (antenna plate) made of flat-plate-shaped acrylic resin, the feeder circuit board 6, the antenna elements 7 and 8, grounding conductors 11, 12 and 13, and jumper conductors 14 and 15. In this case, the antenna elements 7 and 8, and the grounding conductors 11, 12 and 13 are formed on the upper surface of the insulating substrate 5, and the jumper conductors 14 and 15 are formed on the lower surface of the insulating substrate 5. In the present preferred embodiment and its modified preferred embodiments, an xyz coordinate system is defined as shown in FIG. 3. Concretely speaking, referring to FIG. 3, a longitudinal direction of the insulating substrate 5 is defined as an x axis direction, a direction perpendicular to the x axis on the insulating substrate 5 is defined as a y axis direction, and a direction perpendicular to the insulating substrate 5 is defined as a z axis direction.

Referring to FIG. 3, the insulating substrate 5 has, for example, a rectangular shape of 218 mm×55 mm, and has one recess portion 5*a* on one long side. The recess portion 5*a* is provided in a portion, which belongs to the antenna apparatus casing of the antenna apparatus 4 and is attached to the main body casing apparatus 1. In addition, the feeder circuit board 6 is provided at a lower portion of the recess portion 5*a*.

Referring to FIG. 3, the antenna element 7 is a monopole antenna formed in a form of a strip-shaped conductor pattern made of a metal such as copper, on the upper surface of the insulating substrate 5. The antenna element 7 has a first portion 7*a* and a second portion 7*b*. The first portion 7*a* has one end connected to a feeder circuit 107 (See FIG. 4) provided in the feeder circuit board 6, and extends in a positive direction of the y axis. The second portion 7*b* has one end connected to another end of the first portion 7*a*, and extends in a negative direction of the x axis. As shown in FIG. 3, the first portion 7*a* and the second portion 7*b* are perpendicular to each other.

In addition, referring to FIG. 3, the antenna element 8 is a monopole antenna formed in a form of a strip-shaped conductor pattern made of a metal such as copper, on the upper surface of the insulating substrate 5. The antenna element 8 has a third portion 8*a* and a fourth portion 8*b*. The third portion 8*a* has one end connected to a feeder circuit 108 (See FIG. 4) provided in the feeder circuit board 6, and extends in the positive direction of the y axis. The fourth portion 8*b* has one end connected to another end of the third portion 8*a*, and extends in a positive direction of the x axis. As shown in FIG. 3, the third portion 8*a* and the fourth portion 8*b* are perpendicular to each other.

As shown in FIG. 3, the antenna elements 7 and 8 have shapes symmetrical with respect to the y axis. Namely, the first portion 7*a* and the third portion 8*a* are parallel to each other, and each has the same length as each other. In addition, the second portion 7*b* and the fourth portion 8*b* separate and extend in right and left directions, respectively, from the respective another ends of the first portion 7*a* and the third portion 8*a*. It is noted that the resonance frequencies of the antenna elements 7 and 8 are set to resonance frequencies, which are substantially the same as each other and fall within the frequency band (473 MHz to 767 MHz) of the digital terrestrial television broadcasting.

Further, referring to FIG. 3, the grounding conductor 11 is a strip conductor formed between the first portion 7*a* and the third portion 8*a*, so as to extend in the y axis direction. In this case, the grounding conductor 11 has one end connected to a grounding conductor 62*g* (See FIG. 4) provided in the feeder circuit board 6. In addition, the grounding conductor 12 is a strip conductor that has one end connected to the grounding conductor 62*g* (See FIG. 4) provided in the feeder circuit board 6. The grounding conductor 12 is formed on the left-hand side of the first portion 7*a* of the antenna element 7 of FIG. 3, so as to extend in the y axis direction. Further, the grounding conductor 13 is a strip conductor that has one end connected to the grounding conductor 62*g* (See FIG. 4) provided in the feeder circuit board 6. The grounding conductor 13 is formed on the right-hand side of the third portion 8*a* of the antenna element 8 of FIG. 3 so as to extend in the y axis direction. The first portion 7*a*, the third portion 8*a*, the grounding conductors 11, 12 and 13 are parallel to each other. The first portion 7*a* is interposed between the grounding conductors 11 and 12, and the third portion 8*a* is interposed between the grounding conductors 11 and 13.

In addition, referring to FIG. 3, another end of the grounding conductor 12, another end of the grounding conductor 11, and another end of the grounding conductor 13 extend to the lower surface of the insulating substrate 5 by via conductors each of which penetrates the insulating substrate 5. Then, another end of the grounding conductor 12 and another end of the grounding conductor 11 are electrically connected to each other via the jumper conductor 14. Another end of the grounding conductor 11 and another end of the grounding conductor 13 are electrically connected to each other via the jumper conductor 15. It is noted that the jumper conductors 14 and 15 are not electrically connected to the antenna elements 7 and 8. The jumper conductors 14 and 15 are electrical connection elements such as zero-ohm chip resistors soldered on the lower surface of the insulating substrate 5, metal wires or metal foil tapes.

Referring to FIG. 3, each of the antenna elements 7 and 8 and the grounding conductors 11, 12 and 13 has a width of 3 mm, for example. In addition, each of the first portion 7*a* and the third portion 8*a* has a length of 45 mm, for example, and each of the second portion 7*b* and the fourth portion 8*b* has a length of 100 mm, for example. Further, each of the grounding conductors 12 and 13 has a length of 35 mm, and the grounding conductor 11 has a length of 55 mm, for example.

Figure 4:
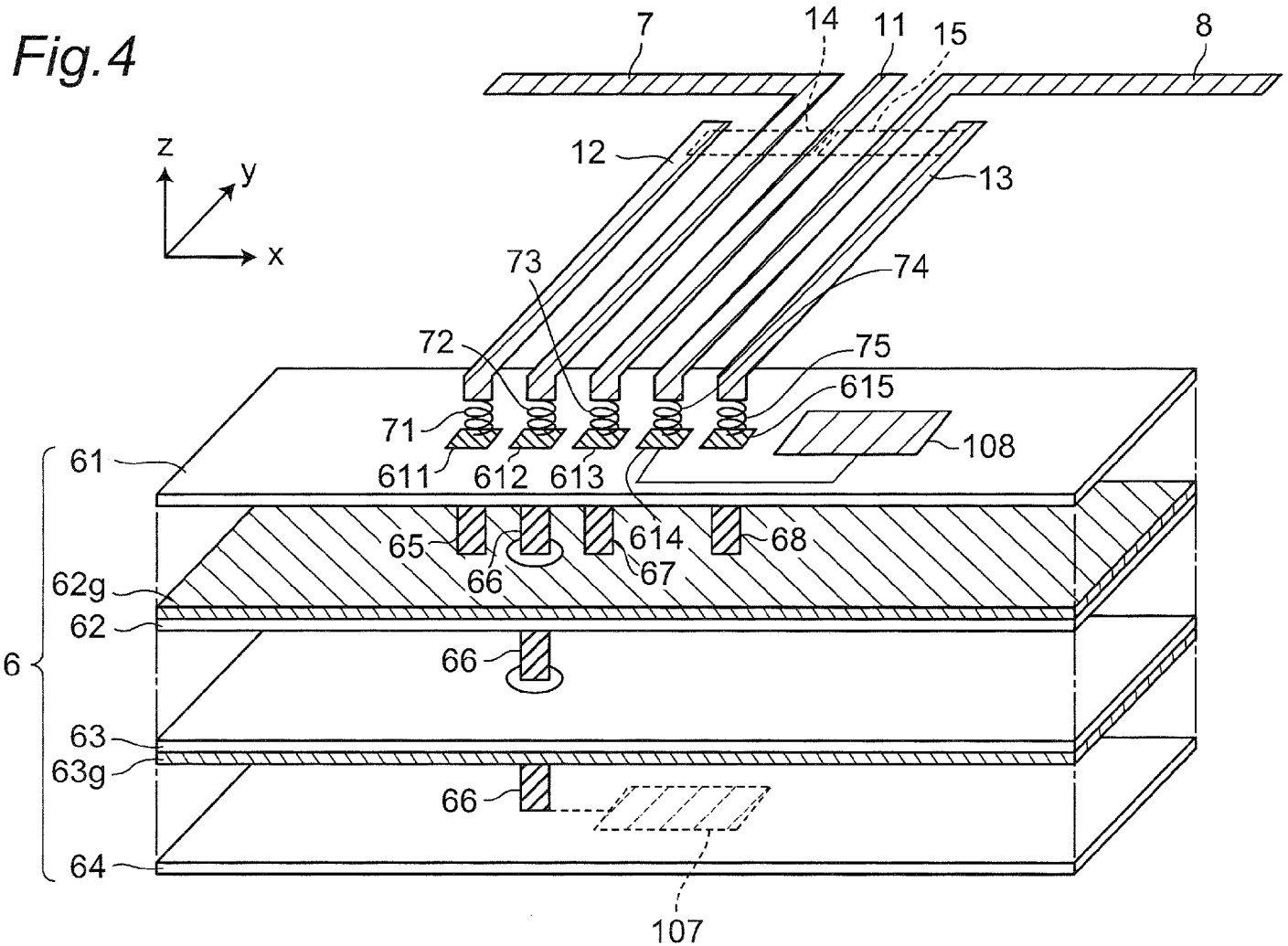
FIG. 4 illustrates an exploded perspective view schematically showing a configuration of a feeder circuit board 6 shown in FIG. 3.

FIG. 4 illustrates an exploded perspective view schematically showing a configuration of the feeder circuit board 6 of FIG. 3. Referring to FIG. 4, the feeder circuit board 6 is a multi-layer wiring board of four layers including layers 61, 62, 63 and 64. In this case, the layer 61 includes conductor pads 611, 612, 613, 614 and 615 formed on the upper surface of the layer 61, and the feeder circuit 108 (antenna circuit) formed on the upper surface of the layer 61. In addition, the layer 62 includes the grounding conductor 62*g* formed on the upper surface of the layer 62. Further, the layer 63 includes a grounding conductor 63*g* formed on the lower surface of the layer 63. Still further, the layer 64 includes the feeder circuit 107 (antenna circuit) formed on the lower surface of the layer 64.

In addition, referring to FIG. 4, respective one ends of the grounding conductor 12, the first portion 7*a* of the antenna element 7, the grounding conductor 11, the third portion 8*a* of the antenna element 8 and the grounding conductor 13 are electrically connected to the conductor pads 611, 612, 613, 614 and 615 via springs 71, 72, 73, 74 and 75, respectively. In addition, the conductor pad 611 is electrically connected to the grounding conductor 62*g* via a via conductor 65, the conductor pad 613 is electrically connected to the grounding conductor 62*g* via a via conductor 67, and the conductor pad 615 is electrically connected to the grounding conductor 62*g* via a via conductor 68. In addition, the conductor pad 612 is connected to the feeder circuit 107 via a via conductor 66, and the conductor pad 614 is connected to the feeder circuit 108 via a wiring conductor.

Namely, referring to FIG. 4, the antenna element 7 is connected to the feeder circuit 107 via the spring 72, the conductor pad 612 and the via conductor 66, while the antenna element 8 is connected to the feeder circuit 108 via the spring 74 and the conductor pad 614. In addition, the grounding conductor 11 is connected to the grounding conductor 62*g* via the spring 73, the conductor pad 613 and the via conductor 67, the grounding conductor 12 is connected to the grounding conductor 62*g* via the spring 71, the conductor pad 611 and the via conductor 65, and the grounding conductor 13 is connected to the grounding conductor 62*g* via the spring 75, the conductor pad 615 and the via conductor 68.

Figure 5:
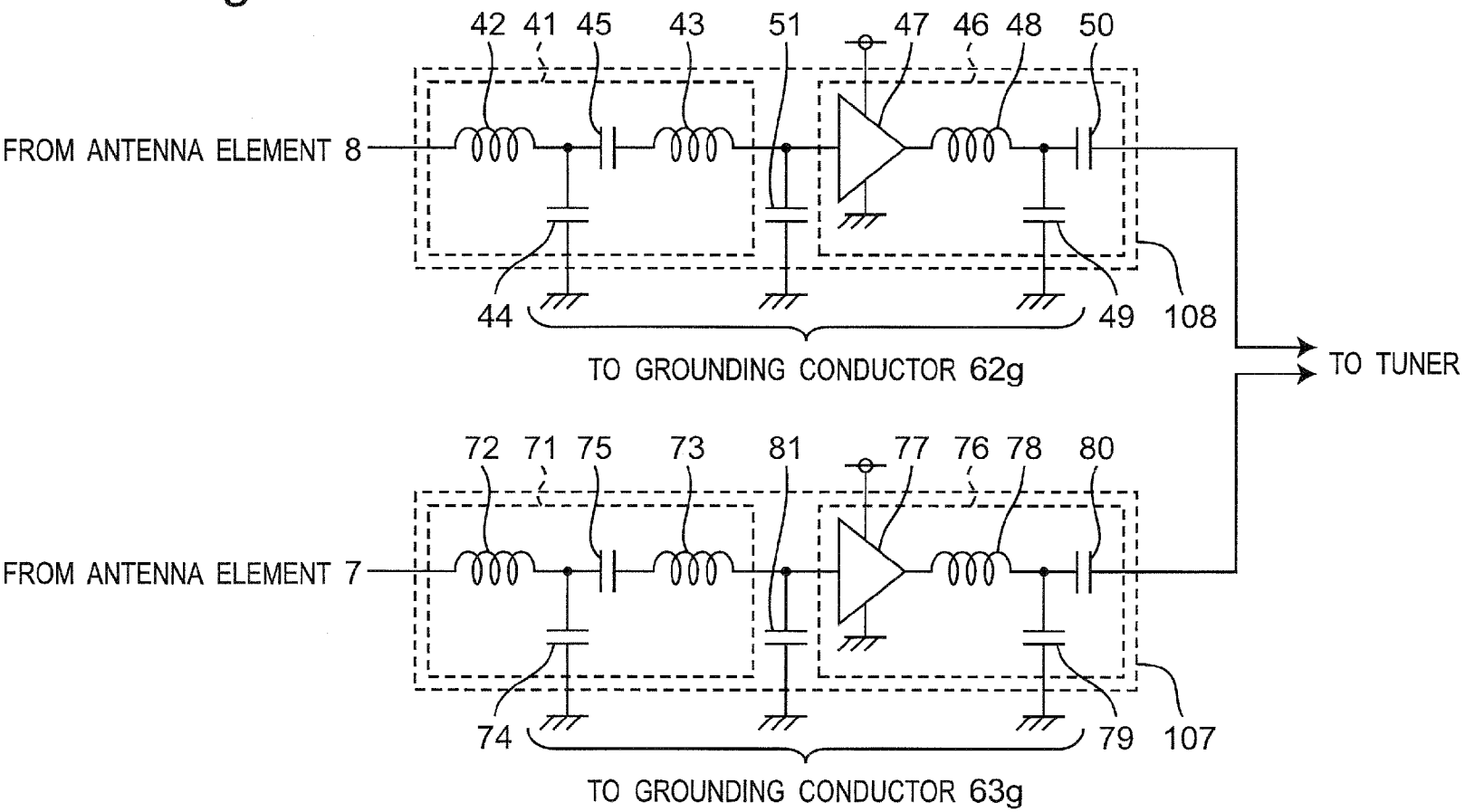
FIG. 5 illustrates a circuit diagram of feeder circuits 107 and 108 shown in FIG. 4.

FIG. 5 illustrates a circuit diagram of the feeder circuits 107 and 108 of FIG. 4. Referring to FIG. 5, the feeder circuit 107 is configured to include an impedance matching circuit 71, an amplifier circuit 76, and a coupling capacitor 81 connected between the impedance matching circuit 71 and the amplifier circuit 76. In addition, the impedance matching circuit 71 is an LC circuit that is configured to include inductors 72 and 73, and capacitors 74 and 75. Further, the amplifier circuit 76 is configured to include an operational amplifier 77, an inductor 78, and capacitors 79 and 80. In addition, the grounding terminal of the feeder circuit 107 is connected to the grounding conductor 63*g* to be grounded. A received signal received by the antenna element 7 is outputted to the above-described tuner via the impedance matching circuit 71 and the amplifier circuit 76.

In addition, referring to FIG. 5, the feeder circuit 108 is configured to include an impedance matching circuit 41, an amplifier circuit 46, and a coupling capacitor 51 connected between the impedance matching circuit 41 and the amplifier circuit 46. In addition, the impedance matching circuit 41 is an LC circuit that is configured to include inductors 42 and 43, and capacitors 44 and 45. Further, the amplifier circuit 46 is configured to include an operational amplifier 47, an inductor 48, and capacitors 49 and 50. In addition, the grounding terminal of the feeder circuit 108 is connected to the grounding conductor 62*g* to be grounded. A received signal received by the antenna element 8 is outputted to the above-described tuner via the impedance matching circuits 41 and the amplifier circuit 46.

In the antenna apparatus 4 configured as described above, the grounding terminal of the feeder circuit 107 is grounded by being connected to the grounding conductor 63*g*, while the grounding terminal of the feeder circuit 108 is grounded by being connected to the grounding conductor 62*g*, as shown in FIG. 4. Therefore, when a radio wave is received by the antenna element 7, the received signal received by the antenna element 7 is outputted to the feeder circuit 107, and a ground current generated in accordance with the receiving operation of the antenna element 7 flows through the grounding conductor 63*g*. On the other hand, when a radio wave is received by the antenna element 8, the received signal received by the antenna element 8 is outputted to the feeder circuit 108, and a ground current generated in accordance with the receiving operation of the antenna element 8 flows through the grounding conductor 62*g*. As a result, the coupling state of the antenna elements 7 and 8 becomes a sparse coupling state, since the ground currents flow through the separate grounding conductors 63*g* and 62*g*, respectively, during the receiving operation of the antenna elements 7 and 8. Therefore, according to the antenna apparatus 4 of the present preferred embodiment, the signal mixing from another antenna element can be prevented, and the decrease in the gain during the signal reception by the antenna elements 7 and 8 can be substantially prevented as compared with the case where the ground currents generated in accordance with the receiving operation of the antenna elements 7 and 8 flow through the same grounding conductor.

In addition, since the antenna apparatus 4 of the present preferred embodiment has the grounding conductor 11, the antenna elements 7 and 8 can be sparsely coupled to each other. Therefore, the decrease in the gain caused by 2C the coupling of the antenna elements 7 and 8 can be suppressed as compared with the case where the grounding conductor 11 is not provided. In addition, a distance between the antenna elements 7 and 8 can be reduced, and therefore, the size of the antenna apparatus 4 can be reduced. In addition, since the antenna apparatus 4 has the grounding conductors 12 and 13, the antenna elements 7 and 8 are prevented from being electromagnetically coupled to the other conductors of the electronic apparatus, and the decrease in the gain of the antenna elements 7 and 8 can be prevented.

Further, the antenna apparatus 4 of the present preferred embodiment has the jumper conductor 14 that electrically connects the grounding conductors 11 and 12, and the jumper conductor 15 that electrically connects the grounding conductors 11 and 13. Therefore, the ground potentials of the grounding conductors 11, 12 and 13 are made common and stabilized, as compared with the case where the jumper conductors 14 and 15 are not provided. Therefore, it is possible to prevent the antenna elements 7 and 8 from being electromagnetically coupled to the other conductors of the electronic apparatus, and it is possible to prevent the decrease in the gain of the antenna elements 7 and 8.

Still further, according to the antenna apparatus 4 of the present preferred embodiment, the antenna element 7 has the first portion 7*a*, and therefore, a distance between the grounding conductor 63*g* and the second portions 7*b* can be secured. In addition, the antenna element 8 has the third portion 8*a*, and therefore, a distance between the grounding conductor 62*g* and the fourth portion 8*b* can be secured. Further, the second portion 7*b* and the fourth portion 8*b* are formed so as to separate in the right and left directions, respectively, from the respective another ends of the first portion 7*a* and the third portion 8*a*, and therefore, the degree of coupling between the antenna elements 7 and 8 can be reduced.

According to the electronic apparatus of the present preferred embodiment, the digital terrestrial television broadcasting can be received with sensibility higher than that of the prior art since the electronic apparatus includes the antenna apparatus 4.

First Modified Preferred Embodiment

Figure 6:
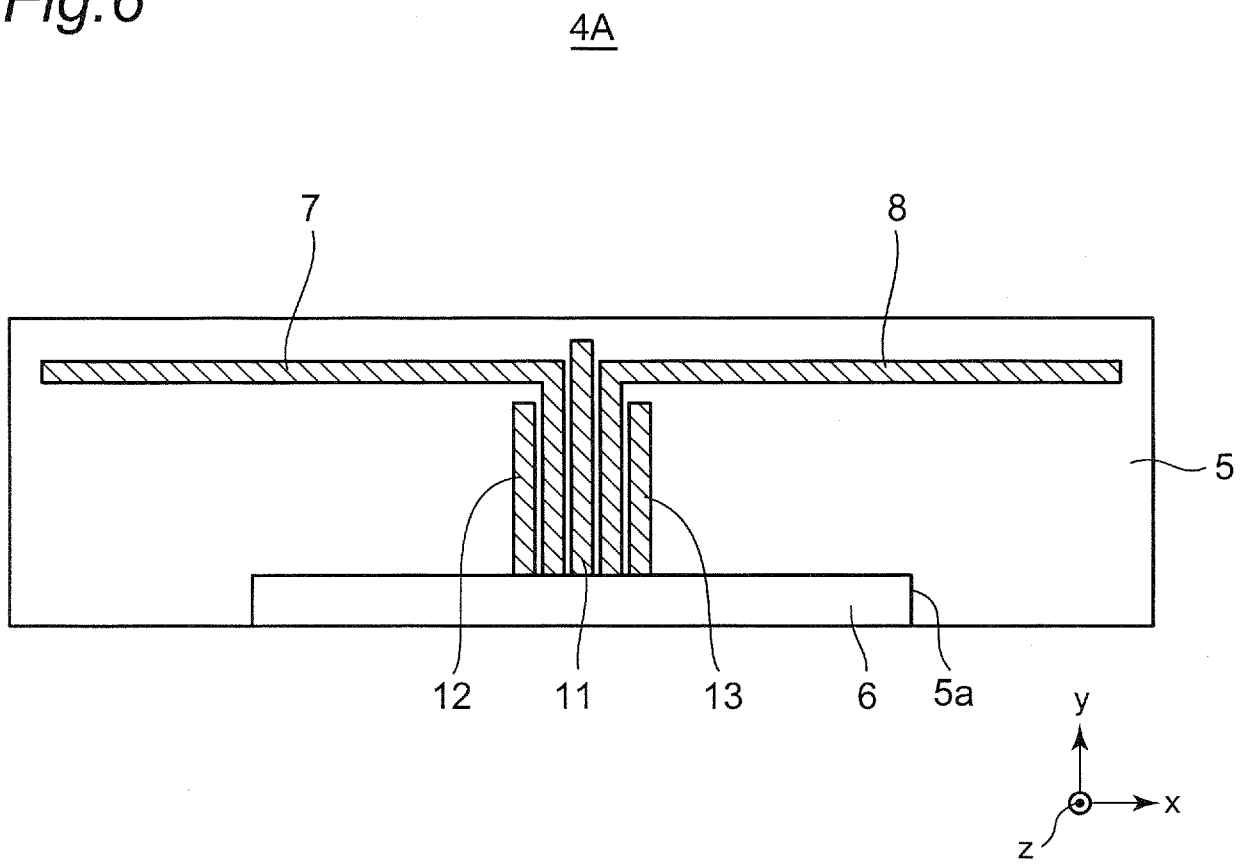
FIG. 6 illustrates a top view showing an insulating substrate 5 and a feeder circuit board 6 provided in an antenna apparatus casing of an antenna apparatus 4A according to a first modified preferred embodiment of the preferred embodiment of the present disclosure.

In the above-described preferred embodiment, the antenna apparatus 4 is configured to include the grounding conductors 11, 12 and 13, and the jumper conductors 14 and 15, however, the present disclosure is not limited to this. FIG. 6 illustrates a top view showing an insulating substrate 5 and a feeder circuit board 6 provided in an antenna apparatus casing of an antenna apparatus 4A according to the first modified preferred embodiment of the preferred embodiment of the present disclosure. The antenna apparatus 4A of the present modified preferred embodiment is different from the antenna apparatus 4 (See FIG. 3) of the preferred embodiment only in a point that the jumper conductors 14 and 15 are not provided.

Since the antenna apparatus 4A of the present modified preferred embodiment has the grounding conductor 11, the antenna elements 7 and 8 can be sparsely coupled with each other. Therefore, the decrease in the gain caused by the coupling of the antenna elements 7 and 8 can be suppressed, as compared with the case where the grounding conductor 11 is not provided. In addition, the distance between the antenna elements 7 and 8 can be reduced, and the size of the antenna apparatus 4 can be reduced. In addition, since the grounding conductors 12 and 13 are provided, the antenna elements 7 and 8 and the other conductors of the electronic apparatus can be prevented from being electromagnetically coupled with each other, and the decrease in the gain of the antenna elements 7 and 8 can be prevented.

Second Modified Preferred Embodiment

Figure 7:
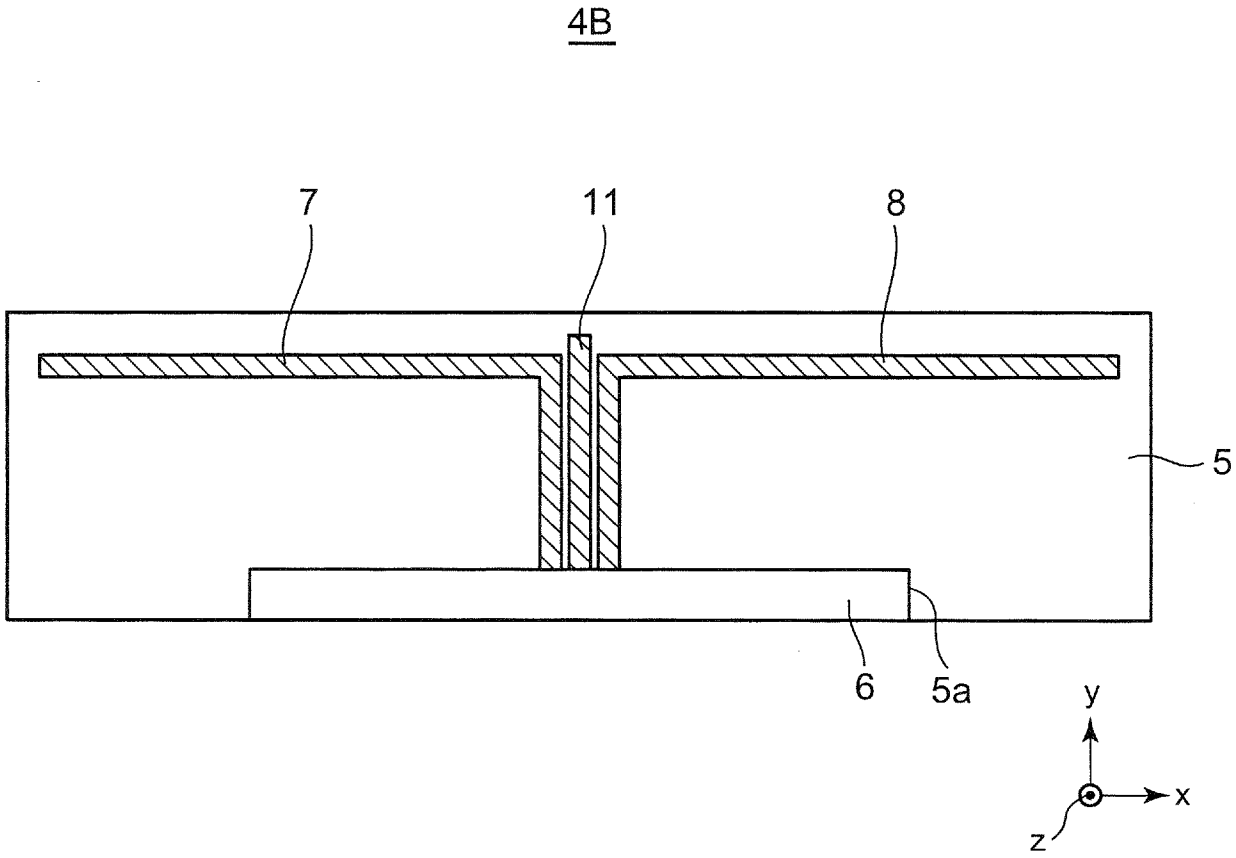
FIG. 7 illustrates a top view showing an insulating substrate 5 and a feeder circuit board 6 provided in an antenna apparatus casing of an antenna apparatus 4B according to a second modified preferred embodiment of the preferred embodiment of the present disclosure.

FIG. 7 illustrates a top view showing an insulating substrate 5 and a feeder circuit board 6 provided in an antenna apparatus casing of an antenna apparatus 4B according to the second modified preferred embodiment of the first preferred embodiment of the present disclosure. The antenna apparatus 4B of the present modified preferred embodiment is different from the antenna apparatus 4 (See FIG. 3) of the preferred embodiment only in a point that the grounding conductors 12 and 13 and the jumper conductors 14 and 15 are not provided. Since the antenna apparatus 4B of the present modified preferred embodiment has the grounding conductor 11, the antenna elements 7 and 8 can be sparsely coupled with each other. Therefore, the decrease in the gain caused by the coupling of the antenna elements 7 and 8 can be suppressed as compared with the case where the grounding conductor 11 is not provided. In addition, the distance between the antenna elements 7 and 8 can be reduced, and the size of the antenna apparatus 4 can be reduced.

It is noted that the decrease in the gain of the antenna elements 7 and 8 can be prevented most effectively, when all of the grounding conductors 11, 12 and 13 and the jumper conductors 14 and 15 are provided in a manner similar to that of the antenna apparatus 4 of the preferred embodiment.

In addition, the antenna apparatuses 4, 4A and 4B wirelessly receive radio waves within the frequency band of the digital terrestrial television broadcasting in the above-described preferred embodiment and its modified preferred embodiments, however, the present disclosure is not limited to this. Each of the antenna apparatuses 4, 4A and 4B may wirelessly transmit a high-frequency signal from a wireless transmitter circuit. In addition, in the above-described preferred embodiment and its modified preferred embodiments, the present disclosure has been described by taking the electronic apparatus that is the portable type television broadcasting receiver apparatus for receiving the radio waves within the frequency band of the digital terrestrial television broadcasting as an example, however, the present disclosure is not limited to this. The present disclosure can be applied to a wireless communication apparatus that has the antenna apparatuses 4, 4A or 4B and a wireless communication circuit to transmit and receive the wireless signals by using the antenna apparatuses 4, 4A or 4B. In addition, the present disclosure can be applied to an electronic apparatus such as a portable telephone that has the above-described wireless communication apparatus and a display apparatus to display the video signal included in the wireless signal received by the wireless communication apparatus.

Industrial Applicability

As described above in detail, according to the antenna apparatus, the wireless communication apparatus and the electronic apparatus of the present disclosure, the grounding terminal of the first feeder circuit is connected to the first grounding conductor to be grounded, so that a ground current flows through the first grounding conductor when a radio wave is received with the first antenna element. The grounding terminal of the second feeder circuit is connected to the second grounding conductor to be grounded, so that a ground current flows through the second grounding conductor when a radio wave is received with the second antenna element. Therefore, the first antenna element and the second antenna element can be sparsely coupled with each other. Therefore, it is possible to prevent signal mixing from another antenna element in the first and second antenna elements, and it is possible to substantially prevent the decrease in the gain during the reception of the respective signals.

Although the present disclosure has been fully described in connection with the preferred embodiments thereof with reference to the accompanying drawings, it is to be noted that various changes and modifications are apparent to those skilled in the art. Such changes and modifications are to be understood as included within the scope of the present disclosure as defined by the appended claims unless they depart therefrom.

What is claimed is:

1. An antenna apparatus comprising:

a first antenna element;

a second antenna element; and a feeder circuit board comprising a first feeder circuit that feeds to the first antenna element, and a second feeder circuit that feeds to the second antenna element, wherein the feeder circuit board is a multi-layer board including first and second grounding conductors, wherein a grounding terminal of the first feeder circuit is connected to the first grounding conductor to be grounded, so that a ground current flows through the first grounding conductor when a radio wave is transmitted or received with the first antenna element, wherein a grounding terminal of the second feeder circuit is connected to the second grounding conductor to be grounded, so that a ground current flows through the second grounding conductor when a radio wave is transmitted or received with the second antenna element, and wherein the first and second grounding conductors are not electrically connected to each other.

2. The antenna apparatus of claim 1, wherein the antenna apparatus further comprises an insulating substrate on which each of the first and second antenna elements is formed in a form of a conductor pattern, wherein the first antenna element comprises:

a first portion that extends in a predetermined first direction and has one end connected to the first feeder circuit; and a second portion that extends in a predetermined second direction and has one end connected to another end of the first portion, wherein the second antenna element comprises:

a third portion that extends in the first direction and has one end connected to the second feeder circuit; and a fourth portion that extends in a predetermined third direction and has one end connected to another end of the third portion, and wherein the antenna apparatus further comprises a third grounding conductor formed between the first and third portions on the insulating substrate.

3. The antenna apparatus of claim 2, further comprising fourth and fifth grounding conductors, each formed on the insulating substrate, wherein the third and fourth grounding conductors are formed so as to interpose the first portion therebetween, and wherein the third and fifth grounding conductors are formed so as to interpose the third portion therebetween.

4. The antenna apparatus of claim 3, further comprising a connecting element that electrically connects the third, fourth and fifth grounding conductors with each other.

5. The antenna apparatus of claim 1, wherein the first and second antenna elements have substantially same resonance frequencies as each other.

6. The wireless communication apparatus as claimed in claim 5, wherein the feeder circuit board is formed by a multi-layered substrate comprising:

a first layer including the first feeder circuit;

the first grounding conductor;

the second grounding conductor; and a second layer including the second feeder circuit.

7. The wireless communication apparatus as claimed in claim 6, wherein the multi-layered substrate is formed to be multi-layered such that the first and second grounding conductors are sandwiched by the first and second layers.

8. The antenna apparatus as claimed in claim 1, wherein the feeder circuit board is formed by a multi-layered substrate comprising:

a first layer including the first feeder circuit;

the first grounding conductor;

the second grounding conductor; and a second layer including the second feeder circuit.

9. The antenna apparatus as claimed in claim 8, wherein the multi-layered substrate is formed to be multi-layered such that the first and second grounding conductors are sandwiched by the first and second layers.

10. A wireless communication apparatus comprising:

an antenna apparatus; and a wireless communication circuit that transmits and receives a wireless signal by using the antenna apparatus, wherein the antenna apparatus comprises:

a first antenna element;

a second antenna element; and a feeder circuit board comprising a first feeder circuit that feeds to the first antenna element, and a second feeder circuit that feeds to the second antenna element, wherein the feeder circuit board is a multi-layer board including first and second grounding conductors, wherein a grounding terminal of the first feeder circuit is connected to the first grounding conductor to be grounded, so that a ground current flows through the first grounding conductor when a radio wave is transmitted or received with the first antenna element, wherein a grounding terminal of the second feeder circuit is connected to the second grounding conductor to be grounded, so that a ground current flows through the second grounding conductor when a radio wave is transmitted or received with the second antenna element, and wherein the first and second grounding conductors are not electrically connected to each other.

11. The electric apparatus as claimed in claim 10, wherein the feeder circuit board is formed by a multi-layered substrate comprising:

a first layer including the first feeder circuit;

the first grounding conductor;

the second grounding conductor; and a second layer including the second feeder circuit.

12. The electric apparatus as claimed in claim 11, wherein the multi-layered substrate is formed to be multi-layered such that the first and second grounding conductors are sandwiched by the first and second layers.

13. An electronic apparatus comprising:

a wireless communication apparatus including an antenna apparatus, and a wireless communication circuit that transmits and receives a wireless signal by using the antenna apparatus; and a display apparatus that displays a video signal included in the wireless signal, wherein the antenna apparatus comprises:

a first antenna element;

a second antenna element; and a feeder circuit board comprising a first feeder circuit that feeds to the first antenna element, and a second feeder circuit that feeds to the second antenna element, wherein the feeder circuit board is a multi-layer board including first and second grounding conductors, wherein a grounding terminal of the first feeder circuit is connected to the first grounding conductor to be grounded, so that a ground current flows through the first grounding conductor when a radio wave is transmitted or received with the first antenna element, wherein a grounding terminal of the second feeder circuit is connected to the second grounding conductor to be grounded, so that a ground current flows through the second grounding conductor when a radio wave is transmitted or received with the second antenna element, and wherein the first and second grounding conductors are not electrically connected to each other.

* * * * *